US006722278B2

(12) United States Patent
Tomita

(10) Patent No.: US 6,722,278 B2
(45) Date of Patent: Apr. 20, 2004

(54) SHEET-FED ROTARY PRINTING PRESS

(75) Inventor: Minoru Tomita, Ibaraki (JP)

(73) Assignee: Komori Corporation, Tokyo (JP)

( * ) Notice: Subject to any disclaimer, the term of this patent is extended or adjusted under 35 U.S.C. 154(b) by 96 days.

(21) Appl. No.: 09/998,561

(22) Filed: Nov. 29, 2001

(65) Prior Publication Data

US 2002/0062748 A1 May 30, 2002

(30) Foreign Application Priority Data

Nov. 30, 2000 (JP) ..... 2000-364403

(51) Int. Cl.[7] ..... B41F 35/06
(52) U.S. Cl. ..... 101/424.1; 101/419
(58) Field of Search ..... 101/424.1, 419, 101/415.1, 475, 217, 216

(56) References Cited

U.S. PATENT DOCUMENTS

| | | | | |
|---|---|---|---|---|
| 3,791,644 A | | 2/1974 | DeMoore | 271/80 |
| 4,517,221 A | * | 5/1985 | Holl | 427/8 |
| 4,524,712 A | * | 6/1985 | Ito | 118/46 |
| 4,848,265 A | * | 7/1989 | Komori | 118/46 |
| 6,073,556 A | * | 6/2000 | DeMoore et al. | 101/232 |
| 6,338,299 B1 | * | 1/2002 | Kamoda et al. | 101/424.1 |

FOREIGN PATENT DOCUMENTS

| | | |
|---|---|---|
| EP | 0059944 | 9/1982 |
| EP | 0723865 | 7/1996 |
| JP | 3-190735 | 8/1991 |
| JP | U 2572032 | 2/1998 |

* cited by examiner

*Primary Examiner*—Anthony H. Nguyen
(74) *Attorney, Agent, or Firm*—Blakely, Sokoloff, Taylor & Zafman

(57) ABSTRACT

A printing press includes first and second impression cylinders and a varnish supply unit. The first impression cylinder has a gripper unit for holding a sheet-like object, and is rotatably supported. The varnish supply unit supplies varnish to the sheet-like object held by the first impression cylinder. The second impression cylinder is in contact with the first cylinder, and has a gripper unit for receiving the sheet-like object held by the first impression cylinder. The sheet-like object held by the gripper unit is transported such that its varnish-coated surface opposes a surface of the second impression cylinder. A fluorine-contained polymer layer is formed on that surface of the second impression cylinder which is in contact with the varnish-coated surface of the sheet-like object.

10 Claims, 2 Drawing Sheets

SHEET-FED ROTARY PRINTING PRESS

BACKGROUND OF THE INVENTION

The present invention relates to a printing press with a varnish unit for coating the lower surface of a sheet with varnish.

As a printing press of this type, one disclosed in Japanese Patent Laid-Open No. 3-190735 is known. The printing press disclosed in this reference has a sheet feed unit for feeding sheets one by one, a coater unit for coating the lower surface of a fed sheet with varnish, and a printing unit for printing an image or the like on the upper surface of the sheet. The coater unit has a coating impression cylinder in contact with an impression cylinder arranged in the printing unit, a coater cylinder in contact with the coating impression cylinder, a coating supply unit for supplying a coating material to the coater cylinder, and a dryer unit for drying varnish applied to the lower surface of the sheet.

In this arrangement, while the sheet fed from the sheet feed unit passes between the coating impression cylinder and coater cylinder, its lower surface is coated with varnish. Then, varnish is dried by the dryer unit. After that, the sheet gripped by the gripper unit of the impression cylinder of the printing unit is transported, by rotation of the impression cylinder, while its lower surface is in contact with the surface of the impression cylinder, and the upper surface of the sheet is printed while the sheet passes between the impression cylinder and a blanket cylinder.

In the conventional printing press described above, a dryer for drying the varnish is comprised of an infrared heater and a fan for blowing off air heated by the infrared heater. However, a dryer with high drying power cannot be installed because of the problem of the space where it is to be installed, the varnish is not dried sufficiently due to the adverse influence of heat to the printing press body, and the like, depending on the type and coating amount of aqueous varnish applied to the sheet. If the varnish is not dried, undried varnish sometimes attaches to the surface of the impression cylinder of the printing unit while the sheet is transferred from the coating impression cylinder to the impression cylinder of the printing unit. The varnish attaching to the surface of the impression cylinder hardens, and undried varnish is repeatedly deposited on it to form a lump of varnish. This damages the sheet transferred to the impression cylinder of the printing unit.

An impression cylinder plate is mounted on the circumferential surface of each of the coating impression cylinder and the impression cylinder of the printing unit in order to prevent damage to the cylinders. Although the impression cylinder plates with surface precision almost equal to that of the surfaces of the cylinders are plated for rust prevention, undried varnish cannot be prevented from attaching to them.

SUMMARY OF THE INVENTION

It is an object of the present invention to provide a printing press in which damage to a sheet on the surface of an impression cylinder is prevented.

In order to achieve the above object, according to the present invention, there is provided a printing press comprising a first cylinder with sheet holding means for holding a sheet-like object and rotatably supported, a varnish unit for supplying varnish to the sheet-like object held by the first cylinder, and a second cylinder in contact with the first cylinder and having second sheet holding means for receiving the sheet-like object held by the first cylinder, the sheet-like object held by the second sheet holding means being transported such that a varnish-coated surface thereof opposes a surface of the second cylinder, wherein a fluorine-contained polymer layer is formed on a surface of the second cylinder which is in contact with the varnish-coated surface of the sheet-like object.

DESCRIPTION OF THE PREFERRED EMBODIMENT

The present invention will be described in detail with reference to the accompanying drawings.

Figure 1:
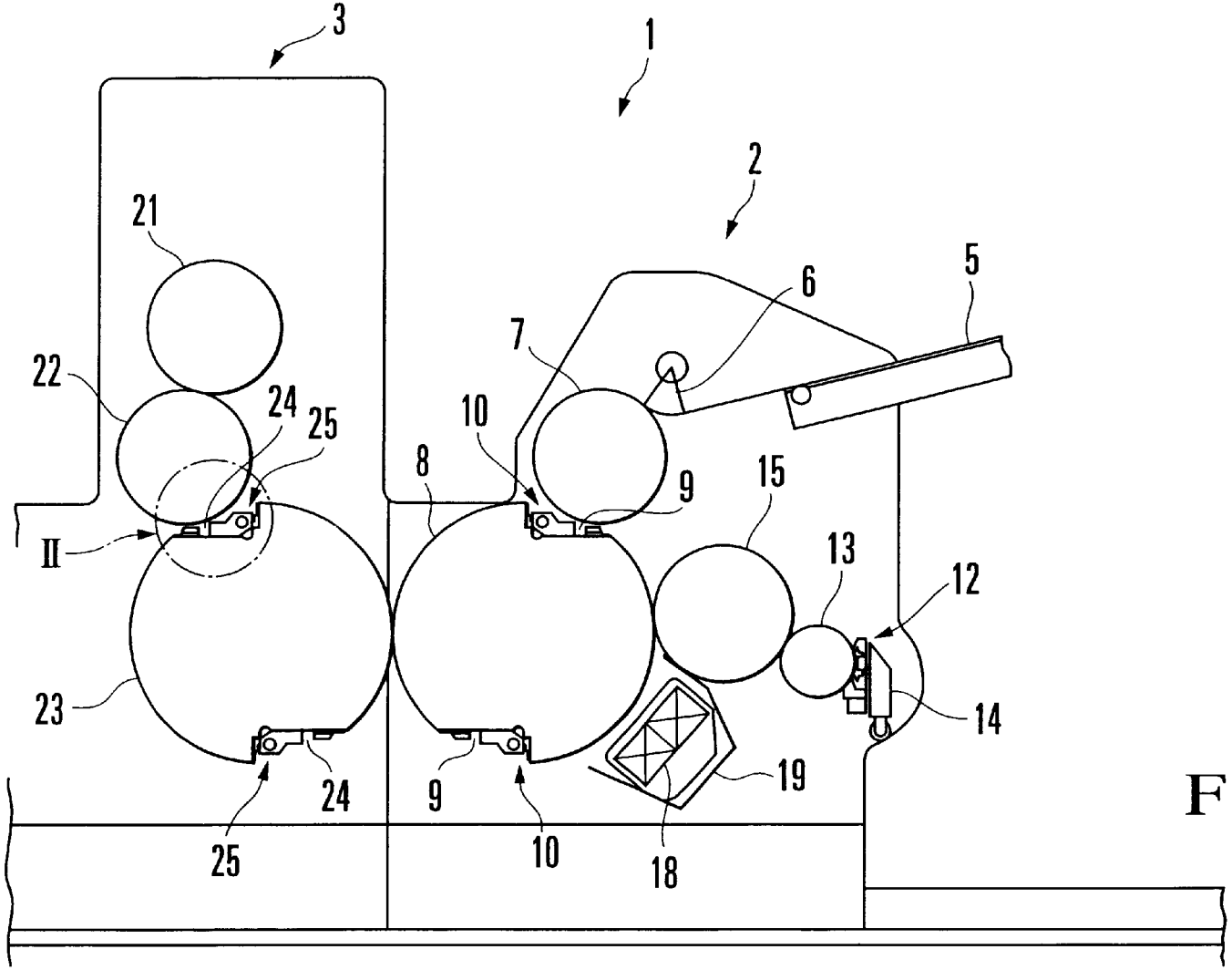
FIG. 1 is a side view of a printing press according to an embodiment of the present invention.

FIG. 1 shows a sheet-fed rotary printing press according to an embodiment of the present invention. Referring to FIG. 1, a printing press 1 has a varnish coating unit 2 for coating with varnish the lower surface of a sheet fed from a sheet feed unit (not shown) through a feedboard 5, and a printing unit 3 subordinately connected to the varnish coating unit 2 to print an image or the like on the upper surface of the sheet fed from the varnish coating unit 2.

The varnish coating unit 2 has a swing arm shaft pregripper 6 for gripping the leading edge of the sheet transported on the feedboard 5 and jogged by a front lay (not shown), a transfer cylinder 7 with a gripper unit (not shown) for performing gripping change of the sheet gripped by the swing arm shaft pregripper 6, a double-size impression cylinder 8 in contact with the transfer cylinder 7, a blanket cylinder 15 in contact with the impression cylinder 8, a varnish supply unit 12 disposed in the vicinity of the blanket cylinder 15 to supply aqueous varnish to the blanket cylinder 15, and a dryer 18 disposed in the vicinity of the circumferential surface of the impression cylinder 8.

The impression cylinder 8 has a pair of gaps 9 located at positions that equally halve the circumferential surface in the circumferential direction and extending in the axial direction. A gripper unit 10 is arranged in each gap 9. The varnish supply unit 12 has a varnish roller 13 in contact with the blanket cylinder 15, and a chamber blade unit 14 for supplying the varnish to the circumferential surface of the varnish roller 13 with a predetermined thickness. The dryer 18 is comprised of an infrared heater and a fan for blowing off air heated by the infrared heater to the impression cylinder 8. The dryer 18 is covered by a light-shielding plate 19 which is open to the impression cylinder 8.

The printing unit 3 has a plate cylinder 21 with a plate-mounted outer surface, a blanket cylinder 22 in contact with the plate cylinder 21, and a double-size impression cylinder 23 in contact with the blanket cylinder 22 and serving as a transport cylinder. The impression cylinder 23 has a pair of gaps 24 located at positions that equally halve the circumferential surface in the circumferential direction and extending in the axial direction. A gripper unit 25 is arranged in each gap 24. The printing unit 3 further has an ink supply unit (not shown) and dampening unit (not shown) for respectively supplying ink and dampening water to the plate mounted on the plate cylinder 21. The image formed on the surface of the plate mounted on the plate cylinder 21 is transferred to the surface of the blanket cylinder 22 with the ink and dampening water. A metal plate 40 (to be described later) is mounted on the circumferential surface of the impression cylinder 23.

The metal plate 40 mounted on the circumferential surface of the impression cylinder 23 will be described with reference to FIG. 2.

Figure 2:
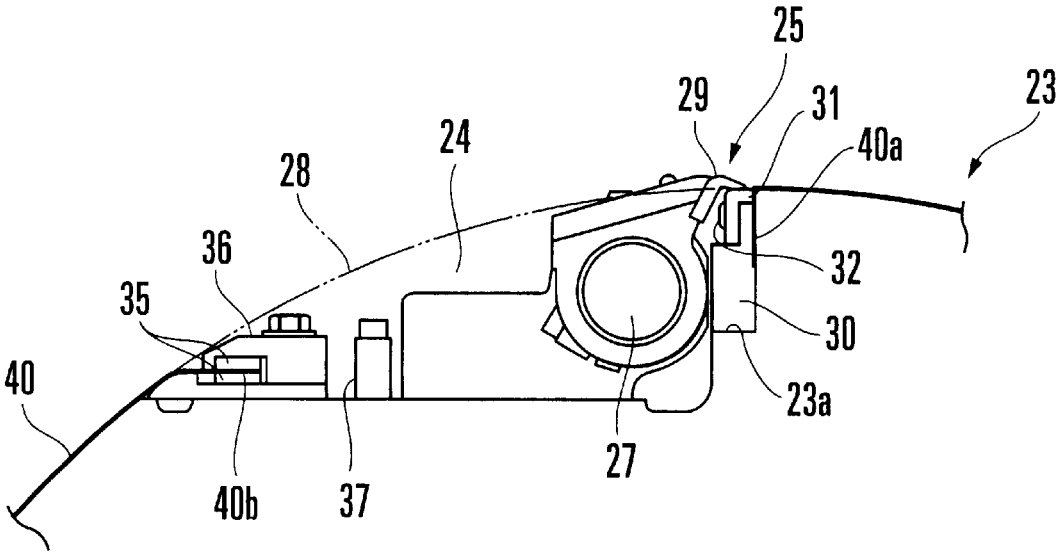
FIG. 2 is an enlarged view of a portion II of FIG. 1.

Referring to FIG. 2, a gripper shaft 27 is arranged in the axial direction of the impression cylinder 23, and its two ends are rotatably supported by bearers 28 fixed to the two ends of the impression cylinder 23. A plurality of grippers 29 arranged at a predetermined interval are fixed on the gripper shaft 27. A stepped bar 30 is arranged in the axial direction of the impression cylinder 23 to be parallel to the gripper shaft 27, and is fixed to a step 23*a*, formed in the side surface of the gap 24, with screws. A plurality of L-shaped gripper pads 31 are fixed to the upper portion of the step of the stepped bar 30 with screws 32. The gripper pads 31 and grippers 29 make up the gripper unit 25.

The gripper unit 25 has a torsion bar (not shown) extending through the gripper shaft 27, and a cam (not shown) engaging with a cam follower fixed to the end of the torsion bar. When the gripper shaft 27 is rotatably driven through the torsion bar and cam in synchronism with the rotation of the printing press, the grippers 29 is opened and closed with respect to the gripper pads 31.

A pair of upper and lower impression cylinder plate bases 35 are positioned by an impression cylinder plate attaching metal fixture 36, extending in the axial direction of the impression cylinder 23, attached to the bottom surface of the gap 24, and having a hook-like section. The impression cylinder plate attaching metal fixture 36 is attached to be adjustable in directions to come close to and separate from a block 37 fixed to the bottom surface of the gap 24.

Figure 3:
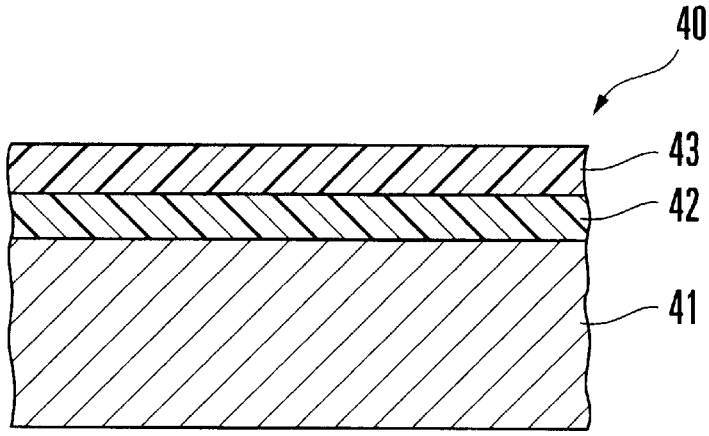
FIG. 3 is an enlarged sectional view of an impression cylinder plate shown in FIG. 2.

The impression cylinder plate 40 mounted on the circumferential surface of the impression cylinder 23 has an end 40*a* formed by bending. The end 40*a* of the metal plate 40 is inserted between the side wall of the gap 24 and the stepped bar 30, and is attached to the upper portion of the step of the stepped bar 30 by fixing to the impression cylinder 23 by fastening screws. The impression cylinder plate 40 is formed of an aluminum plate made of a material softer than that of the impression cylinder 23. As shown in FIG. 3, a rustproof aluminum oxide film 42 is formed by anodization on the surface of an aluminum plate 41 for the impression cylinder plate 40, and a highly repellent fluorine-contained polymer layer 43 is formed on it by bake coating.

The other end 40*b* of the impression cylinder plate 40 is sandwiched between the impression cylinder plate bases 35. In this state, when the impression cylinder plate attaching metal fixture 36 is adjusted by moving it in the direction to come close to the block 37, the impression cylinder plate 40 is pulled to come in tight contact with the circumferential surface of the impression cylinder 23. Then, the impression cylinder plate attaching metal fixture 36 is fixed to the impression cylinder 23 with the bolts, so the impression cylinder plate 40 is mounted on the circumferential surface of the impression cylinder 23.

An impression cylinder plate, on which a highly repellent fluorine-contained polymer layer is formed in the same manner as on the impression cylinder plate 40, is mounted on the circumferential surface of the impression cylinder 8 with the same support mechanism as that of the impression cylinder 23. The structure and impression cylinder support mechanism of an impression cylinder plate described in Japanese Utility Model Registration No. 2572032 are incorporated in this specification.

The printing operation of the printing press with the above arrangement will be described.

The sheets are fed from the sheet feed unit one by one. Each fed sheet is jogged in the circumferential and widthwise directions on the feedboard 5, and its leading edge is gripped by the grippers of the swing arm shaft pregripper 6. In this state, when the swing arm shaft pregripper 6 swings, the sheet gripped by its grippers is gripped by the gripper unit of the transfer cylinder 7. The gripped sheet is transported as the transfer cylinder 7 rotates, and is gripped by the gripper unit 10 of the impression cylinder 8 at its contact portion with the impression cylinder 8. The gripped sheet is transported as the impression cylinder 8 rotates, and varnish is applied to its lower surface while it passes between the blanket cylinder 15 and impression cylinder 8.

The applied varnish is dried while the sheet passes through the dryer 18, and the sheet is gripped to the gripper unit 25 at the contact portion between the impression cylinder 8 and the impression cylinder 23 of the printing unit 3. During this change in gripping, even when a plurality of sheets are inserted in an overlaying manner between the impression cylinders 8 and 23, they do not damage the surfaces of the cylinders 8 and 23 themselves because of the impression cylinder plates 40 mounted on the circumferential surfaces of the cylinders 8 and 23 and softer than the materials of the cylinders 8 and 23.

The sheet gripped by the gripper unit 25 is transported, as the impression cylinder 23 rotates, such that its varnish-coated lower surface is in contact with the impression cylinder plate 40 of the impression cylinder 23, and its upper surface is printed while it passes between the impression cylinder 23 and blanket cylinder 22. Even if the varnish applied to the lower surface of the sheet is not sufficiently dried by the dryer 18, the highly repellent fluorine-contained polymer layer 43 formed on the surface of the impression cylinder plate 40, which is in contact the lower surface of the sheet, repels the undried varnish.

According to this embodiment, undried varnish does not attach to the surface of the impression cylinder plate 40, and a lump formed by deposition of set varnish is not formed on the impression cylinder plate 40, so damage to the sheet received by the impression cylinder 23 can be prevented. Also, damage to the surface of the impression cylinder plate of the impression cylinder 8 in contact with the impression cylinder 23 can also be prevented.

This applies to the impression cylinder 8 side. The fluorine-contained polymer layer, which is formed on the impression cylinder plate mounted on the surface side of the impression cylinder 8, i.e., mounted on the circumferential surface of the impression cylinder 8, or which is directly formed on the impression cylinder 8, repels undried varnish. A fluorine-contained polymer layer is formed also on the impression cylinder 8 due to the following reason. When varnish is supplied from the varnish supply unit 12 to a sheet-like object held by the impression cylinder 8, sometimes the trailing side of the impression cylinder 8 is exposed from the sheet-like object depending on the length of the sheet-like object in the transport direction. In this case, varnish must be prevented from attaching to the exposed portion of the impression cylinder 8.

If the sheet-like object has a maximum size, or that portion of the blanket of the blanket cylinder 15 which opposes that portion of the varnish which is left on the trailing side of the impression cylinder 8 is cut off (no blanket is formed on the trailing side), a fluorine-contained polymer layer need not be formed on the surface of the impression cylinder 8.

According to this embodiment, since the fluorine-contained polymer layer 43 can be formed before the impression cylinder plate is mounted on the impression cylinder, it can be formed easily. Also, since an existing impression cylinder plate is utilized, a countermeasure for undried varnish can be realized at a low cost.

In the above embodiment, the impression cylinder plate 40 is formed of an anodized aluminum plate. Alternatively, the impression cylinder plate 40 may be formed of a chrome-plated copper plate. It suffices as far as the impression cylinder plate 40 is a component which is formed by subjecting a material softer than that of the impression cylinder 23 to rust prevention and which is to be mounted on the circumferential surface of the impression cylinder. The fluorine-contained polymer layer 43 is formed on the surface of the impression cylinder plate 40. If the impression cylinder plate 40 is not to be used, a fluorine-contained polymer layer 43 may be directly formed on the circumferential surface of the impression cylinder 23. Also, the impression cylinder plate 40 itself may be made of fluorine-contained polymers.

As an example of the transport cylinder in contact with the impression cylinder 8 of the varnish coating unit 2, the impression cylinder 23 of the printing unit 3 has been described. Alternatively, a transport cylinder may be a transfer cylinder. On the impression cylinder 8 side where a smaller amount of undried varnish attaches than on the circumferential surface of the impression cylinder 23, a fluorine-contained polymer layer is not necessarily formed on the surface of the impression cylinder plate of the impression cylinder 8.

A case wherein one printing unit 3 is used has been described. In the case of a multi-color (four-color) printing press, a varnish coating unit 2 is disposed in front of the first-color printing unit.

As has been described above, according to the present invention, since the fluorine-contained polymer layer repels undried varnish, damage to the sheet by undried varnish can be prevented. Also, unwanted damage to the impression cylinder plate can also be prevented.

What is claimed is:

1. A printing press comprising:

a first cylinder with sheet holding means for holding a sheet-like object and rotatably supported;

a varnish unit for supplying varnish to a surface of the sheet-like object held by said first cylinder; and an impression cylinder coupled with said first cylinder and having second sheet holding means for receiving the sheet-like object held by said first cylinder, the sheet-like object held by said second sheet holding means being transported where to cause a varnish-coated surface thereof to contact with a surface of said impression cylinder, wherein said impression cylinder has a surface coupled with a fluorine based polymer layer which is in contact with the varnish-coated surface of the sheet-like object.

2. A printing press according to claim 1, further comprising a plate member mounted on a circumferential surface of said impression cylinder and made of a material softer than that of said impression cylinder, said plate member having a surface coupled with said fluorine based polymer.

3. A printing press according to claim 1, further comprising a plate member mounted on a circumferential surface of said impression cylinder and made of fluorine-contained polymers.

4. A printing press according to claim 1, wherein said fluorine-contained polymer layer is directly coupled to the surface of said impression cylinder.

5. A printing press according to claim 1, further comprising a plate member mounted on a circumferential surface of said impression cylinder, wherein said fluorine-contained polymer layer is coupled to a surface of the plate member through rustproof aluminum oxide.

6. A printing press according to claim 1, wherein said fluorine-contained polymer layer is coupled to a surface of said first cylinder.

7. A printing press according to claim 1, further comprising a plate member mounted on a circumferential surface of said first cylinder and made of a material softer than that of said first cylinder.

8. A printing press according to claim 1, further comprising a drying unit adjacent to said first cylinder opposing said varnish unit, said drying unit dries the varnish-coated surface of the sheet-like object held by said first cylinder.

9. A printing press according to claim 1, further comprising a varnish coating unit with said first cylinder and said varnish unit, and a printing unit connected in tandem with said varnish coating unit and having said impression cylinder.

10. A printing press according to claim 9, wherein said first cylinder is a varnish coating impression cylinder, and said second cylinder is a printing impression cylinder.

* * * * *